United States Patent [19]

Rekow

[11] 4,192,423

[45] Mar. 11, 1980

[54] CORNER PAD

[75] Inventor: Vernon C. Rekow, St. Paul, Minn.

[73] Assignee: Champion International Corporation, Stamford, Conn.

[21] Appl. No.: 958,115

[22] Filed: Nov. 6, 1978

[51] Int. Cl.[2] ..... B65D 85/30

[52] U.S. Cl. ..... 206/586; 229/DIG. 1; 248/345.1

[58] Field of Search ..... 229/DIG. 1; 206/586, 206/320, 326; 248/345.1

[56] References Cited

U.S. PATENT DOCUMENTS

| | | | |
|---|---|---|---|
| 2,476,197 | 7/1949 | Kincaid | 206/586 X |
| 2,509,468 | 5/1950 | Anderson, Jr. | 206/586 |
| 2,692,720 | 10/1954 | Suess et al. | 206/586 |
| 3,151,832 | 10/1964 | Doll | 248/345.1 |
| 3,220,683 | 11/1965 | Doll | 248/345.1 |
| 3,900,156 | 8/1975 | Clark, Jr. | 229/DIG. 1 X |

FOREIGN PATENT DOCUMENTS

| | | | |
|---|---|---|---|
| 1088423 | 9/1960 | Fed. Rep. of Germany | 229/DIG. 1 |

*Primary Examiner*—Stephen P. Garbe

[57] ABSTRACT

A corner pad for protecting furniture and like articles during shipment is formed from a planar, one piece corrugated blank folded into a four ply tetrahedron. The pad is formed by folding a rectangular array of panels of the blank in a consecutive counter-clockwise sequence. The four-ply tetrahedron corner pad is draped over the corner of an article and provides substantial cushioning protection to the corner during shipment of the article in a container.

3 Claims, 10 Drawing Figures

Fig. 5.
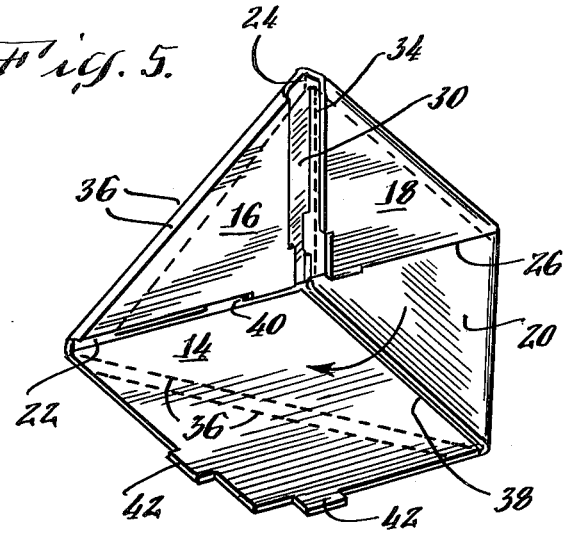
Fig. 6.
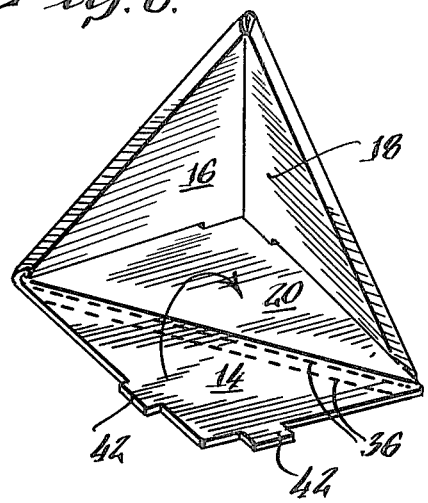
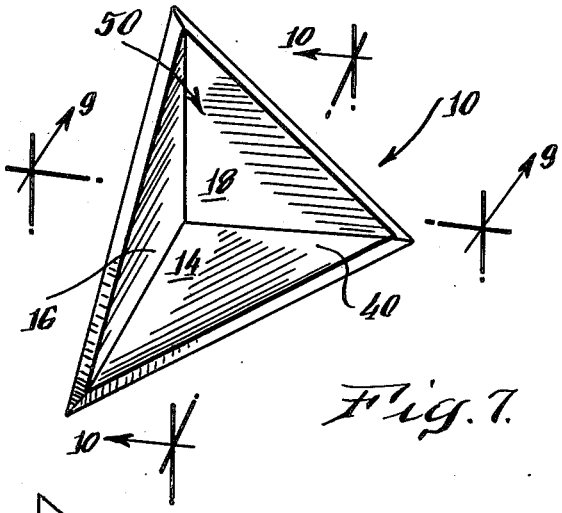
Fig. 7.
Fig. 8.
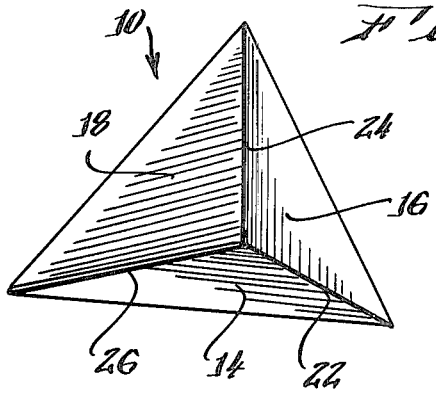
Fig. 9.
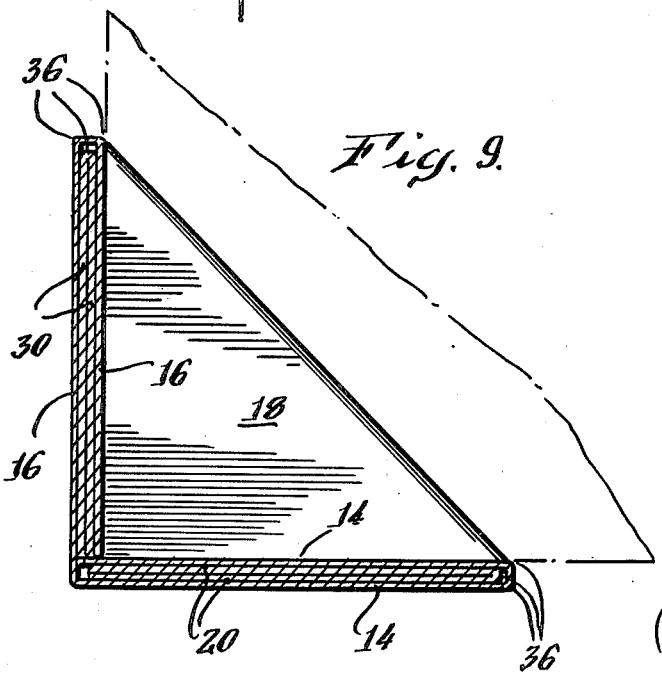
Fig. 10.
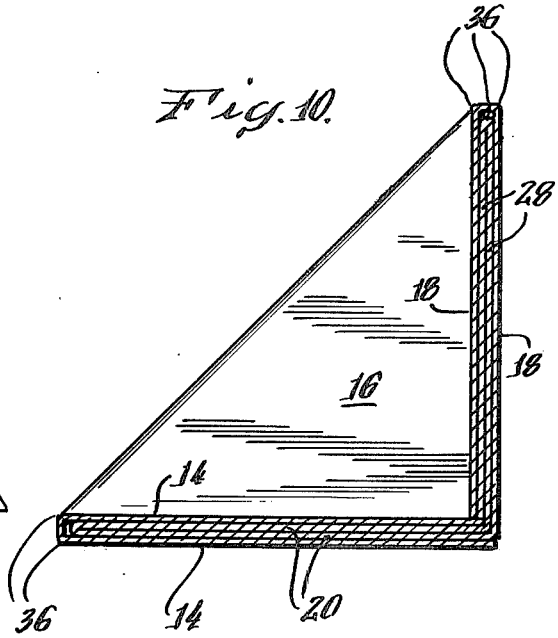

CORNER PAD

BACKGROUND OF THE INVENTION

1. Field of the Invention

This invention relates to a corner pad construction and the blank therefor, and more particularly, a four-ply tetrahedron-shaped corner pad.

2. Description of the Prior Art

Protective corner pads are commonly used to absorb shock due to rough handling of containers housing such rectangular objects as furniture cabinets, door frames, etc. The pads are disposed over the three-dimensional corner of the article prior to packing of the article within the container for shipment. Such pads serve to preclude movement of the article within the shipping container and cushion the article against jars or shocks imported to the container.

Prior art corner pads have not been totally satisfactory in use. The mode of assembly thereof is complex. Further, such pads have usually been of one or two-ply construction, thereby limiting the shock-absorbing capabilities of the pad and defeating its purpose.

SUMMARY OF THE INVENTION

In accordance with the present invention, a corner pad adapted to fit over the corner of a piece of furniture or similar article is made from a one-piece, corrugated, paperboard blank. The blank is folded about score lines provided between and in side wall forming panels of the pad. The panels are arranged in a rectangular array in the blank and are folded in consecutive sequence forming a tetrahedron configuration having an open base for receiving the three-dimentional corner of the piece of furniture or a similar article.

The blank includes a rectangular array of four rectangular side wall forming panels connected to each other by horizontal and vertical fold lines. Two similar rectangular panels form an extension from one side edge of one of the side wall-forming panels of the blank in the rectangular array. Each of the side wall forming panels in the array and extension panels includes a diagonal fold line.

The folding sequence is initiated by folding one of the lowermost side wall-forming panels in the rectangular array, which is connected to the two extension panels, about its diagonal fold line. Then, each of the top two rectangular side wall-forming panels, in the array moving in a counterclockwise sequence, is folded about its diagonal score line and about horizontal and vertical score lines connecting them to other panels in the array. The folding action automatically causes the extension panels to be folded about its diagonal fold lines and trapped between the overlapping portions of the two top side wall forming panels to form two, four-ply walls. The fourth rectangular side wall-forming panel in the array is then folded about its diagonal score line and overlapped with the other lower side wall-forming panels to form a four-ply tetrahedron corner pad with an open base. The side wall panels of the tetrahedron corner pad are locked to retain the tetrahedron configuration by inserting locking tabs on the fourth side-wall forming panel within notches provided in the lower edge of adjacent side walls.

The unique and simple folding sequence renders the pad easy to erect. The four-ply configuration provides substantial cushioning and shock-absorbing support for an article, such as a piece of furniture, when the open base is positioned over a corner.

BRIEF DESCRIPTION OF THE DRAWING

Further objects and advantages of the invention will become more apparent from the following description and claims, and from the accompanying drawings, wherein:

FIGS. 2 through 6, inclusive, are perspective views illustrating the manner of folding the blank of FIG. 1 to form the corner pad of the present invention;

FIG. 7 is a front perspective view of the corner pad of the present invention;

FIG. 8 is a rear perspective view of the corner pad of the present invention;

FIG. 9 is a cross-sectional view taken substantially along the plane indicated by the line 9—9 of FIG. 7; and FIG. 10 is a cross-sectional view taken substantially along the plane indicated by the line 10—10 of FIG. 7.

DETAILED DESCRIPTION OF THE PREFERRED EMBODIMENT

Figure 1:
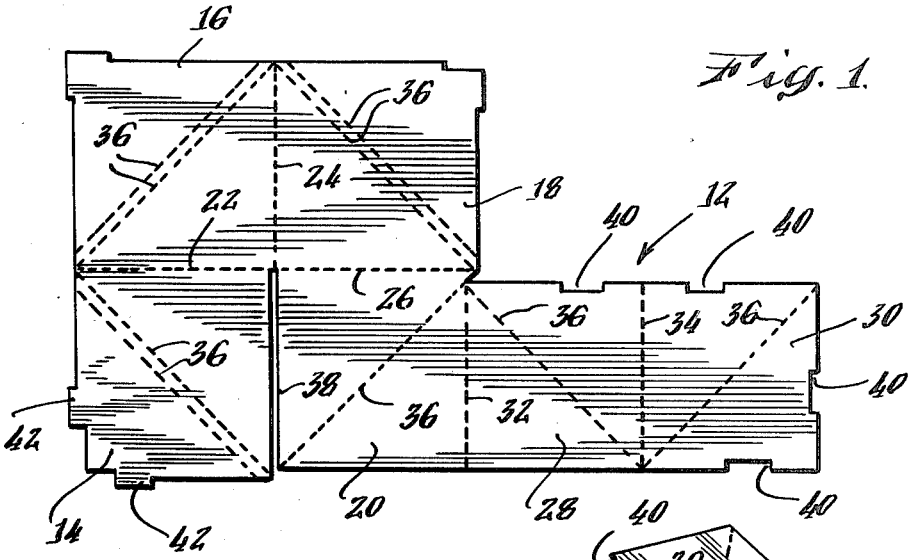
FIG. 1 is a top plan view of a blank for forming the corner pad of the present invention.

Referring now to the drawings in detail, wherein like numerals indicate like elements throughout the several views, a tetrahedron-shaped corner pad 10 in accordance with the present invention is formed from a planar, integral paperboard blank 12 illustrated in FIG. 1.

The blank 12 includes a plurality of substantially rectangular panels 14, 16, 18, and 20 hingedly connected together along score lines 22, 24, and 26, respectively, and arranged in a rectangular array. Horizontal score line 22 connects panels 14 and 16, vertical score line 24 connects panels 16 and 18, and horizontal score line 26 connects panels 18 and 20. A pair of rectangular extension panels 28 and 30 are provided. Panel 28 is connected by a vertical score line 32 to a side edge of panel 20, while extension panel 30 is hingedly connected to panel 28 by a vertical score line 34. Panels 16 and 18 form an upper series of panels, while panels 14, 20, 28 and 30 form a lower series thereof.

Each of the panels 16, 18, 20, 22, 28 and 30 also include a diagonal score line 36. The score line 36 on panels 14, 16, and 18 are double parallel score lines, whereas the remaining diagonal score lines are only singular. The score lines 36 on adjacent panels extend at right angles to each other.

Adjacent panels 14 and 20 are free to move relative to each other by a cut line 38 therebetween. Extension panels 28 and 30 include rectangular notches 40 on various edges. In connection with panel 28, a notch 40 appears on the top edge, whereas three notches 40 are provided along the top, free side, and bottom edge of the panel 30. Tabs 42 of approximately the same dimension as the notches 40 are provided on the bottom and free side edges of the rectangular panel 14.

FIGS. 2 to 6, inclusive illustrate the manner of folding blank 12 into a tetrahedron-shaped corner pad 10 illustrated in FIGS. 7 to 10. The rectangular panels 14, 16, and 18, form the side walls of the tetrahedron corner pad 10.

Figure 2:
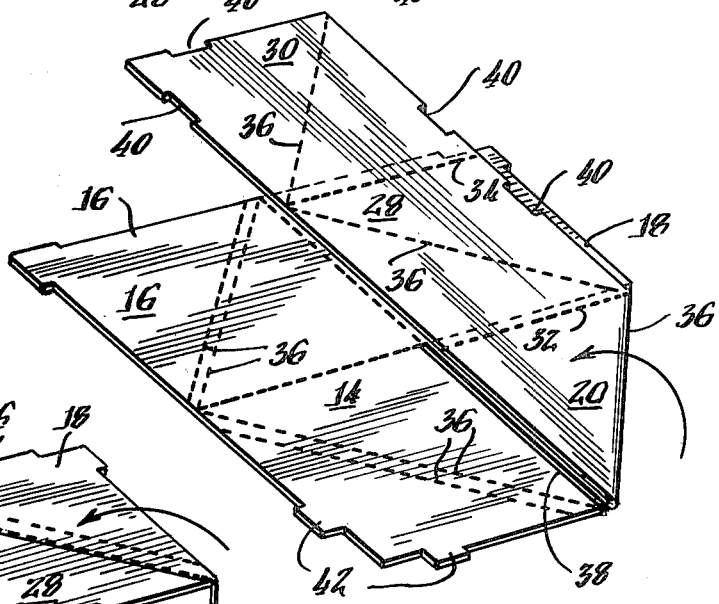
Figure 3:
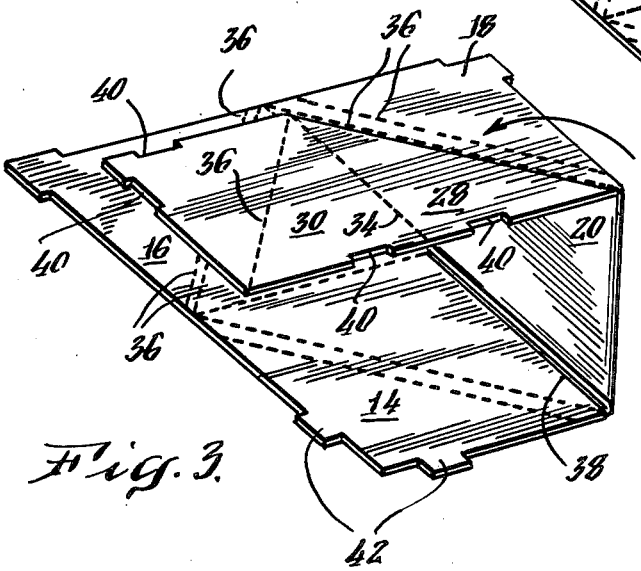
Figure 4:
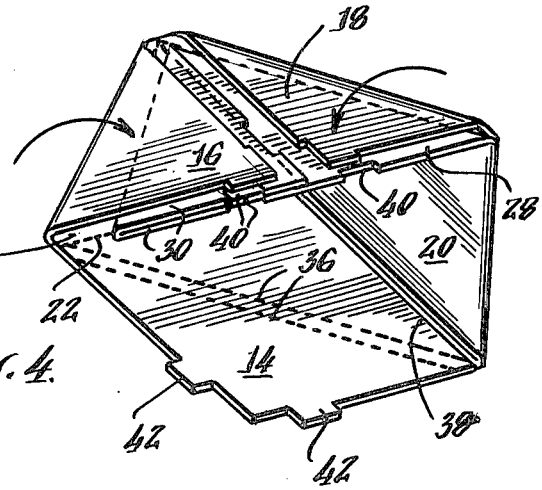

The folding sequence is accomplished by folding the rectangular array of panels 14, 16, 18 and 20 in a counterclockwise direction about their diagonal score lines 36. The sequence is initiated by folding rectangular panel 20 about its diagonal score line 36 (FIG. 2). The folding action is then continued in the counterclockwise sequence by folding panel 18 about its double score line 36, which automatically causes panel 28 to fold in half about its diagonal score line 36 (see FIG. 3), and positions extension panel 30 on panel 16. The halves of panel 18 will overly the top and bottom half of panel 28 to form a four-ply side wall structure consisting of panels 18, 28, 28 and 18, in out-to-in sequence. This side wall forms an upright portion of the partially folded blank (see FIGS. 4 and 5), when the panels 16 and 18 are folded about horizontal score lines 22 and 26.

Proceeding counterclockwise in the rectangular array the side wall panel 16 is then folded in half about its double diagonal score line 36, which in turn will cause the panel 30 to fold back upon itself about its diagonal score line 36 (FIG. 4) within the panel 16. Thus, a second, four-ply side wall is formed consisting in out-to-in sequence of the panels 16, 30, 30, and 16.

At this point, the four-ply side walls 18, 28, 28, 18 and 16, 30, 30, 16, are folded to an upright position about fold lines 22 and 26 (FIG. 5). Four-ply side wall 18, 28, 28, and 18 along with the folded over side wall 20 are then rotated as indicated by the arrow in FIG. 5, 90° about vertical fold line 24 until the doubled over side wall 20 overlies the remaining unfolded side wall panel 14 of blank 12. The blank has now assumed its basic tetrahedron shape with an open base 50 (FIG. 6), exposing the notches 40 beneath the inner side wall plies 16 and 18 in the side wall plies 30 and 28, respectively. To complete the corner pad 10, it is only necessary to fold the fourth or remaining side wall 14 in half about its double score line 36 as indicated by the arrow in FIG. 6, to overly and sandwich panel 20 therebetween. A third, four-ply side wall is formed which consists of in out-to-in sequence the panels 14, 20, 20, and 14. The tabs 42 on inner ply 14 are inserted within the notches 40 to lock the side walls in their tetrahedron configuration.

Each side wall of the tetrahedron corner pad 10 is of a four-ply construction, providing more than an ample cushion for an article inserted within the open base 50 of the tetrahedron. As indicated, the folding sequence is simply effected by folding the four side wall panels about their diagonals in a counterclockwise sequence, trapping the extension panels and one of the side wall panels between the other three to form the four-ply construction.

What is claimed as new is as follows:

1. A blank for forming a corner pad comprising:

two upper substantially square panels connected to four lower substantially square panels, two of said square panels of said lower four square panels being connected along a score line to said upper square panels, said uppper square panels being connected along a score line to each other, and said two remaining lower panels being connected to each other, at least one of said two remaining panels being connected to at least one of said other lower square panels by a score line, each of said square panels including a score line extending along a diagonal, some of said diagonal score lines consisting of two parallel lines, and some of the edges of at least one of said bottom panels including a notch cut.

2. The blank of claim 1 wherein one of said lower panels includes a tab extending outwardly along two sides thereof.

3. The blank of claim 1 wherein the other lower square panels include a cut line therebetween.

* * * * *